US006315227B1

(12) United States Patent
Schoeck

(10) Patent No.: US 6,315,227 B1
(45) Date of Patent: Nov. 13, 2001

(54) BOBBIN CORES FOR SIDELESS PRE-WOUND SEWING THREAD BOBBINS AND METHODS OF WINDING THE SAME

(75) Inventor: Vincent E. Schoeck, Hagerstown, MD (US)

(73) Assignee: Fil-TEC, Inc., Cavetown, MD (US)

( * ) Notice: Subject to any disclaimer, the term of this patent is extended or adjusted under 35 U.S.C. 154(b) by 0 days.

(21) Appl. No.: 09/447,741

(22) Filed: Nov. 23, 1999

(51) Int. Cl.[7] ..... B65H 55/00; B65H 75/10; B65H 75/18; B65H 49/18

(52) U.S. Cl. ..... 242/159; 242/610.5; 242/613.5; 242/611.2; 242/118.32; 242/596.4; 242/596.7; 242/611

(58) Field of Search ..... 242/159, 610.5, 242/613.5, 613, 611, 611.2, 118.3, 118.32, 596.4, 596.7

(56) References Cited

U.S. PATENT DOCUMENTS 36,782 * 10/1862 Hussey ..... 242/118.3
659,306 * 10/1900 Kingsland ..... 242/611.2
1,967,676 * 7/1934 Marchev ..... 242/596.4
2,875,961 * 3/1959 Mori et al. ..... 242/118.32
3,074,666 * 1/1963 Hawley ..... 242/118.3 X
3,716,202 * 2/1973 Thomas ..... 242/118.32 X
4,008,860 * 2/1977 Tanaka ..... 242/118.32 X
4,489,541 * 12/1984 Boling ..... 242/118.3 X
5,653,395 * 8/1997 Iwade et al. ..... 242/118.32 X

* cited by examiner

*Primary Examiner*—Donald P. Walsh
*Assistant Examiner*—Minh-Chau Pham
(74) *Attorney, Agent, or Firm*—Nixon & Vanderhye P.C.

(57) ABSTRACT

Cylindrical bobbin cores have at least one radially oriented slot formed in at least one end thereof. The slot is sized and configured to mate with a radially extending blade associated with the drive head of the winder so as to achieve positive rotational drive therebetween. In view of this interconnection between the core and the drive head, significantly less spring pressure needs to be exerted against the core by the tail stock of the winder.

9 Claims, 2 Drawing Sheets

Fig. 3
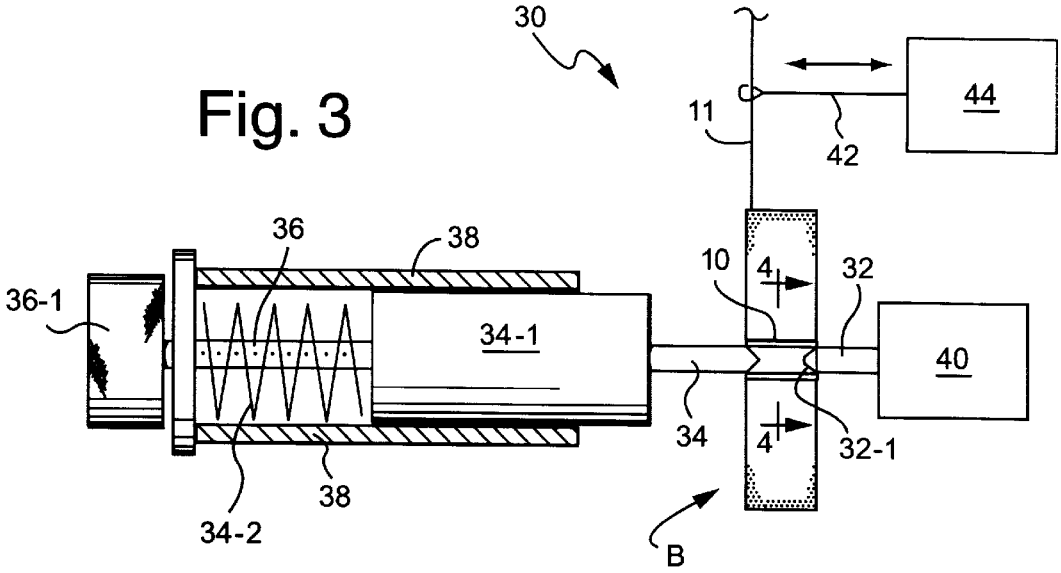
Fig. 4
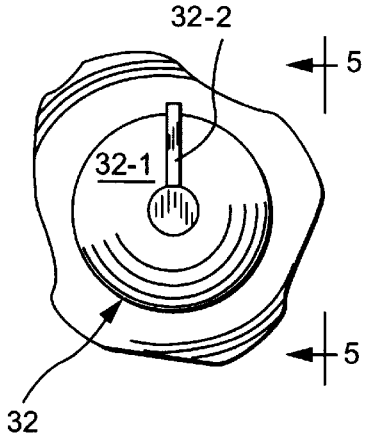
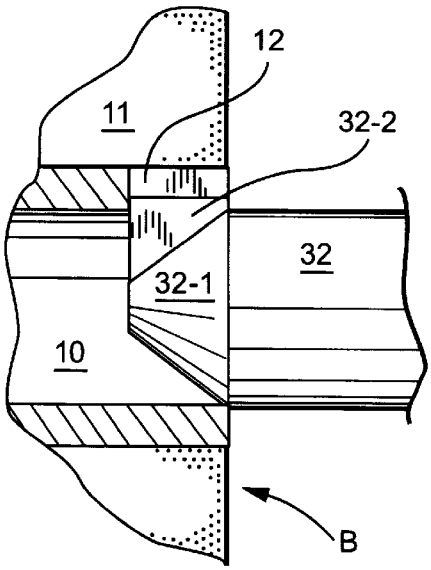
Fig. 5

BOBBIN CORES FOR SIDELESS PRE-WOUND SEWING THREAD BOBBINS AND METHODS OF WINDING THE SAME

FIELD OF THE INVENTION

The present invention relates generally to bobbin cores, especially those for use as cores for sideless bobbins pre-wound with sewing thread.

BACKGROUND AND SUMMARY OF THE INVENTION

The conventional technique to drive bobbin cores during a thread-winding operation involves providing a "knifed" or "serrated" drive head associated with the winder which physically digs into the bobbin core. The serrated drive head spins at high speeds and is intended to prevent the core from slipping during the thread-winding operation. In this regard, even small amounts of core slippage during thread-winding causes the bobbin to be out-of-specification due to incorrect thread tensions.

There are several disadvantages associated with the use of conventional serrated drive heads. Specifically, over time the serrations on the drive head become dull due to wear and tear. As they dull, small amounts of slippage may occur which is evidenced by incorrect thread tensions resulting in out-of-specification bobbins. In addition, small amounts of debris or other material may become trapped in the serrations which again might lead to relative slippage between the drive head and the bobbin core. Needless to say, the ends of the cores become scarred due to the frictional engagement with the serrated drive head—a possibility that can lead to structural weakness in the bobbin core and/or a core which becomes out-of-round.

The amount of spring pressure required to hold the drive heads against the bobbin core to prevent slippage can also cause operator difficulty during doffing of the wound bobbins and replacement with fresh bobbin cores. That is, as the serrated drive head becomes worn, greater spring pressures are needed in order to overcome the tendency of the bobbin core to slip.

Recently, novel magnetic bobbin cores and sideless pre-wound bobbins employing the same are disclosed in copending U.S. patent application Ser. No. 09/447,740 filed concurrently herewith, the entire content of which is expressly incorporated hereinto by reference. In general, such bobbin cores include a cylindrical core with at least one end thereof being permanently magnetized. In preferred forms, the bobbin cores are formed from a thermoplastic or thermoset resin in which magnetized particles are dispersed. The problems noted above, can sometimes be exacerbated by the permanent magnetism exhibited by such bobbin cores.

It would therefore be highly desirable if bobbin cores, especially magnetized bobbin cores, could be provided which overcome these difficulties. It is toward providing solutions to such problems that the present invention is directed.

Broadly, the present invention is embodied in cylindrical bobbin cores which have at least one radially oriented slot formed in at least one end thereof. The slot is sized and configured to mate with a radially extending blade associated with the drive head of the winder so as to achieve positive rotational drive therebetween. In view of this interconnection between the core and the drive head, significantly less spring pressure needs to be exerted against the core by the tail stock of the winder.

These, and other, aspects and advantages of the present invention will become more clear after careful consideration is given to the following detailed description of the preferred exemplary embodiments thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein, FIG. 1 is a perspective view of a sideless pre-wound bobbin employing a notched bobbin core in accordance with the present invention;

FIG. 3 is schematic side elevational view, partly in section, of a bobbin winder system in accordance with the present invention;

FIG. 4 is an enlarged front end view as taken along line 4—4 in FIG. 3 of the drive head employed in the winder system therein; and FIG. 5 is an enlarged side elevational view as taken along line 5—5 in FIG. 4 showing the mated relationship between the bobbin and the drive head during a bobbin winding process.

DETAILED DESCRIPTION OF THE INVENTION

Figure 1:
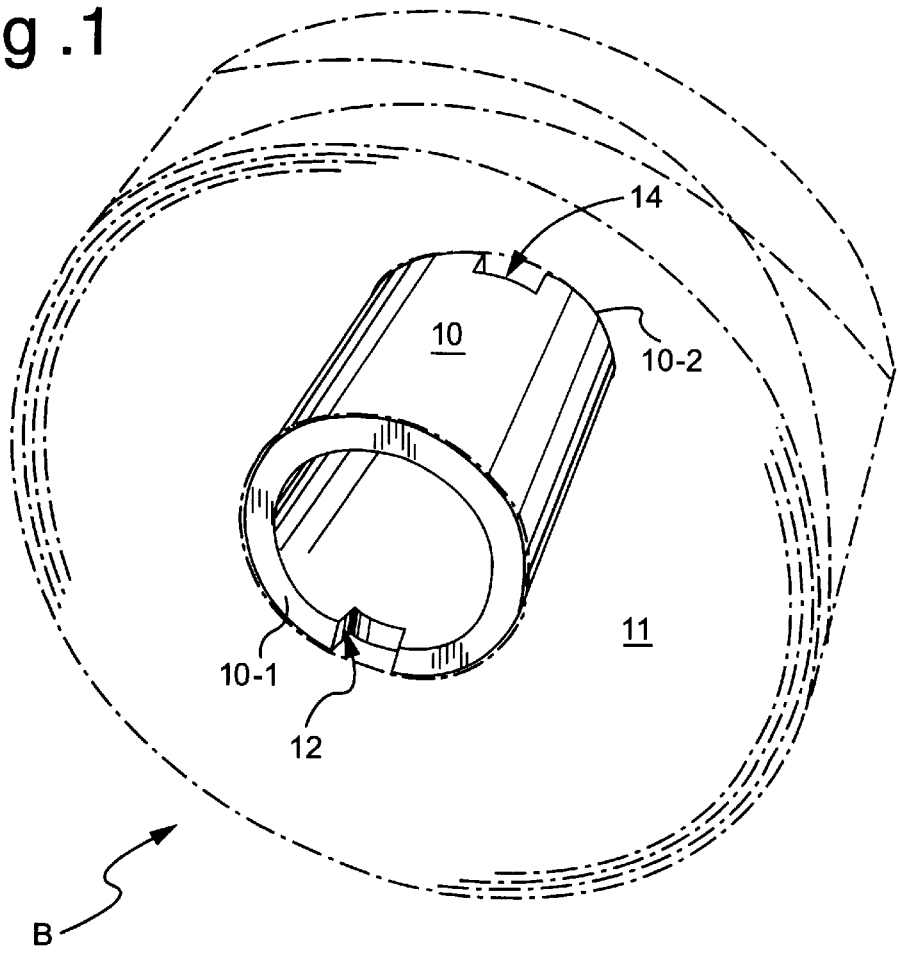

Accompanying FIG. 1 shows a sideless bobbin B which includes a core 10 around which a continuous length of thread 11 is wound. The core 10 is cylindrical and most preferably has a diameter which is substantially the same as its lengthwise dimension. The thread 11 is thus wound upon the bobbin 10 to form a cylindrical bobbin structure B whose diameter is about three times its lengthwise dimension.

As shown, the core 10 includes a radially oriented slot 12 formed in end face 10-1. The slot 12 is oriented radially along a lengthwise bisecting plane of the core 10. Most preferably, the core 10 also has a radially oriented slot 14 defined in its opposite end face 10-2. In this regard, the slot 14 is oriented along the same lengthwise bisecting plane of the core 10, but is 180° out of phase with the slot 12.

Figure 2:
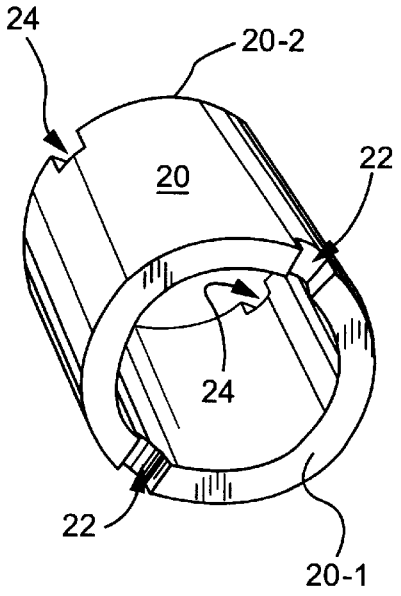
FIG. 2 is perspective view of another embodiment of a notched bobbin core in accordance with the present invention.

Another embodiment of a bobbin core 20 is depicted in accompanying FIG. 2. Most preferably, the bobbin core 20 is similarly sized as compared to the bobbin core 10 described above. However, according to this embodiment of the invention, the bobbin core 20 includes a pair of diametrically opposed slots 22 formed on end face 20-1 and a pair of diametrically opposed slots 24 formed on the opposite end face 202. These pairs of slots 22, 24 are oriented relative to respective lengthwise bisecting planes of the core 20 so as to be mutually orthogonally disposed relative to one another. That is, each of the slots 22 is disposed radially at an orientation that is substantially 90° relative to the slots 24, and vice versa.

The bobbin cores 10 and 20 are most preferably magnetized as described more fully in the co-pending patent application Ser. No. 09/447,740 filed on Nov. 23, 1999 cited above. In this regard, the bobbin cores 10 and 20 are most preferably a flangeless, sideless bobbin having at least one end which is permanently magnetized. However, the cores may be non-magnetic, if desired.

A thread-winding system 30 in which the bobbin cores 10 and/or 20 may be used is shown in FIG. 3. The discussion which follows will refer to core 10 as depicted in FIG. 1, but it will be understood that the discussion is equally applicable to core 20 depicted in FIG. 2. In this regard, the core 10 is positioned between coaxially opposed drive head 32 and tail stock 34. The tail stock 34 is biased by means of spring 34-2 toward the drive head 32. Spring pressure is adjustable by means of the threaded shaft 36 which is threadably engaged with the slide block 34-1 of the tail stock 34. Thus, turning movements applied to the knob 36-1 of the shaft 36 will cause the block 34-1 to reciprocally move within guides 38 thereby increasing or decreasing the spring pressure exerted against the core 10.

The terminal end 32-1 of the drive head 32 is shown in greater detail in accompanying FIGS. 4 and 5. As seen therein, the terminal end 32-1 of the drive head 32 is generally conically shaped so as to be insertable within the interior space of the cylindrical core 10. The terminal end 32-1 carries a rigid radially projecting blade 32-2 which is mated within the slot 12 of core 10. Thus, this mated relationship between the terminal end 32-1 of the drive head 32 and the slot 12 of core 10 provides for positive drive of the latter by the former.

In use, the drive head 32 is rotated by means of a drive motor 40 (see FIG. 3). During winding operation, therefore, the core 10 is frictionally engaged between the drive head 32 and tail stock 34 and is rotated by the drive head 32 by virtue of the positive mated drive relationship between the radially extending blade 32-2 and the slot 12. Simultaneously during such rotation, the thread 11 is directed to the core 10 by a traversing arm 42 which reciprocates by traverse cam 44. The traversing arm 42 reciprocally causes the thread 11 to traverse from one end of the core 10 to the other. After a period of time, therefore, a quantity of the thread 11 will be wound upon the core 10.

When sufficient amount of the thread 11 has been built up on the core 10 to form the bobbin B, the winding operation is stopped to allow 10 automatic doffing of the bobbin B. At that time, a fresh bobbin is placed between the drive head 32 and tail stock 34 and the process repeated. It should be noted here that the operator does not need to align the slot 12 and blade 32-2 when a fresh core 10 is initially coaxially placed between the drive head 32 and tail stock 34. Instead, the spring pressure exerted by the tail stock 34 is sufficient to maintain the core 10 positionally therebetween. On rotation of the drive head 32, therefore, relative slippage occurs between the terminal end 32-1 of the drive head 32 and the adjacent end 10-1 of the core 10 until such time as the blade 32-2 is rotated into alignment with the slot 12. At the moment of such alignment, then, the spring pressure will urge the blade 32-2 to be seated within the slot 12 so that thereafter, positive rotational drive may be transferred to the core 10 by the drive head 32.

As can be appreciated, the mated relationship between the blade 32-2 and the slot 12 of the core 10 prevents relative slippage from occurring therebetween. Moreover, because of this positive drive arrangement, minimal spring tension needs to be applied against the core 10 by mans of the tail stock 34. As such, if manual doffing of the bobbin B and replacement with a fresh core 10 is required, then it is an easier task for the operator.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A pre-wound flangeless, sideless bobbin comprising a cylindrical bobbin core, and a continuous length thread wound about said core, wherein said core is permanently magnetized, and includes at least one radially oriented slot at one end thereof.

2. The bobbin of claim 1, wherein said core includes another radially oriented slot at another end thereof.

3. The bobbin of claim 2, wherein said one and another slots are disposed 180° relative to one another.

4. The bobbin of claim 1, wherein said core includes a pair of radially oriented slots at said one end thereof.

5. The bobbin of claim 4, wherein said pair of slots are diametrically opposed to one another.

6. The bobbin of claim 4, wherein said core includes another pair of radially oriented slots which are diametrically opposed to one another at another end thereof, and wherein said another pair of said slots are oriented substantially orthogonally relative to said first-mentioned pair of said slots.

7. A method of making a flangeless, sideless pre-wound bobbin by winding a continuous length of thread about a bobbin core comprising:

(a) positioning a flangeless, sideless bobbin core which is permanently magnetized and includes at least one radially extending notch between a terminal end of a drive head and a spring-biased tail stock associated with a thread winder;

(b) causing a radially oriented blade fixed to the terminal end of the drive head to be seated within the slot; and then (c) rotating the drive head to cause the blade seated within the slot to positively rotationally drive the core to wind a sufficient amount of the thread about the core, thereby forming the bobbin.

8. The method of claim 7, wherein step (b) is practiced by initially misregistering the slot of the core and the blade of the drive head, and then initially rotating the drive head to cause slippage between the drive head and the core until the blade of the drive head and the slot of the core are registered with one another, whereupon the blade is seated within the slot.

9. The method of claim 7 or 8, wherein step (a) is practiced by adjusting the spring force of the tail stock such that relative slippage occurs between the drive head and the core in the absence of the blade being seated within the slot.

* * * * *